US010207532B2

(12) United States Patent
Thurailingam

(10) Patent No.: US 10,207,532 B2
(45) Date of Patent: Feb. 19, 2019

(54) SECURITY DOCUMENT HAVING A PROTECTED WINDOW AND METHOD FOR MAKING THE SAME

(71) Applicant: Canadian Bank Note Company, Limited, Ottawa (CA)

(72) Inventor: Thivaharan Thurailingam, Kanata (CA)

(73) Assignee: Canadian Bank Note Company, Limited, Ottawa, Ontario (CA)

( * ) Notice: Subject to any disclaimer, the term of this patent is extended or adjusted under 35 U.S.C. 154(b) by 0 days.

(21) Appl. No.: 15/500,309

(22) PCT Filed: Jul. 30, 2014

(86) PCT No.: PCT/CA2014/050719
§ 371 (c)(1),
(2) Date: Jan. 30, 2017

(87) PCT Pub. No.: WO2016/015130
PCT Pub. Date: Feb. 4, 2016

(65) Prior Publication Data

US 2017/0217243 A1 Aug. 3, 2017

(51) Int. Cl.
*B42D 25/351* (2014.01)
*B42D 25/337* (2014.01)
(Continued)

(52) U.S. Cl.
CPC ..... *B42D 25/351* (2014.10); *B42D 25/23* (2014.10); *B42D 25/24* (2014.10); *B42D 25/337* (2014.10); *B42D 25/41* (2014.10)

(58) Field of Classification Search
CPC ..... B42D 25/351; B42D 25/337; B42D 2035/36; B42D 2035/50
See application file for complete search history.

(56) References Cited

U.S. PATENT DOCUMENTS 6,089,614 A * 7/2000 Howland ..... B42D 25/355 283/109
8,141,908 B2 * 3/2012 Whiteman ..... B42D 25/351 283/114

(Continued)

FOREIGN PATENT DOCUMENTS

EP 0388090 A1 * 9/1990 ..... B42D 25/29

OTHER PUBLICATIONS

SCP5600 (2007) http://www.labelsandlabeling.com/news/latest/muehlbauer-systems-personalize-portuguese-identity-cards.*

*Primary Examiner* — Kyle R Grabowski
(74) *Attorney, Agent, or Firm* — Olson & Cepuritis, Ltd.

(57) ABSTRACT

The present invention provides an improved security document having a "see-through" security feature that protects a window of the security document in which personalization information may be displayed, such as an image of the authorized document holder. The "see-through" security feature is provided by front and back side images, such as text (e.g. micro-text or encoded indicia), graphics or other image type, that may be laser marked onto the document substrate from a front side thereof through the window to a back side of the window. At least a part of the front image and at least a part of the back image are in front-to-back registration in window, the registration of the images being subject to verification by suitable inspection of the window. The front and back images may be partial images of a composite image when joined together at a juncture with the front-to-back registration of the partial images located at the juncture so that the images together have an appearance of the composite image in the window. Alternatively, at least a part of the first and second images may be identical with the front-to-back registration of the images located at least one of the identical parts so that the first and second images have (Continued)

an appearance in the window of a single image at those identical parts of the front-to-back registration.

17 Claims, 5 Drawing Sheets

(51) Int. Cl.
*B42D 25/41* (2014.01)
*B42D 25/23* (2014.01)
*B42D 25/24* (2014.01)

(56) References Cited

U.S. PATENT DOCUMENTS

| | | | | |
|---|---|---|---|---|
| 8,226,125 | B2 * | 7/2012 | Williams | B42D 25/29 283/72 |
| 8,573,650 | B2 | 11/2013 | Gregarek et al. | |
| 2003/0015866 | A1 * | 1/2003 | Cioffi | B42D 15/085 283/72 |
| 2003/0193184 | A1 | 10/2003 | Taylor et al. | |
| 2008/0143095 | A1 * | 6/2008 | Isherwood | B42D 25/00 283/72 |
| 2010/0295290 | A1 * | 11/2010 | Muth | B42D 25/351 283/109 |

* cited by examiner

SECURITY DOCUMENT HAVING A PROTECTED WINDOW AND METHOD FOR MAKING THE SAME

CROSS-REFERENCE TO RELATED APPLICATIONS

This application is a U.S. National Stage of PCT/CA2014/050719, filed Jul. 30, 2014, which is incorporated herein by reference.

FIELD OF THE INVENTION

The invention relates generally to security documents having thermoplastic substrates with windows formed therein for displaying images, and, more particularly, to such a security document having a secured window that is resistant to tampering, and a method of making the same.

BACKGROUND

Security documents such as identification cards, passport's, driver's licenses, health cards, etc. typically include one or more printed images which are used to identify the cardholder or other entity associated with the security document. For example, a security document in the form of an identification card, a driver's license or personal identification sheet of a passport may have a thermoplastic substrate and bear a printed photograph of the person to whom the card, license or passport was issued (referred to as a personalization image) to identify and verify a person holding the security document. This photograph may, for example, be printed onto the thermoplastic substrate by means of laser marking, whereby a laser sensitive thermoplastic substrate is marked by applying a laser beam to it which causes it to discolour (i.e. mark), or by ink jet printing using an ultraviolet (UV) curable ink.

It is desirable that personalization images (i.e. images used to authenticate the identity of a cardholder) applied to security documents be resistant to tampering by forgers, such as by replacing an authentic, personalized image with a non-authentic image. Typically, security documents display such a personalized image within a transparent window formed in an opacified substrate of the document. To forge such a security document a forger may choose to alter such image by cutting out the window and replacing it with another displaying a different image. Consequently, there is a need to protect the window of a security document against fraudulent removal in order to protect against such tampering and improve security.

SUMMARY OF THE INVENTION

The present invention provides an improved security document having a "see-through" security feature that protects a transparent window in which personalization information may be displayed, such as an image of the authorized document holder. The "see-through" security feature is provided by a predetermined image, such as text (e.g. micro-text or encoded indicia), graphics or other image, that is marked onto the document substrate from a front side thereof through the window to a back side of the window. An embodiment of the invention illustrated and described herein uses laser marking, which marks the security document by discolouring a laser sensitive layer, to apply the image of the "see-through" feature to the security document. An alternative embodiment might, for example, use ink jet printing to apply the image. The image is applied in such a manner that it extends from the front to the back of document in the area of the transparent window, with front-to-back image elements in registration, such that an inspection of the security document window can verify whether an expected front-to-back ("see-through") image is present in the window. For ease of reference, the registered front-to-back image is alternately described herein as a "see-through" security feature.

A "see-through" security feature according to the invention makes it difficult for a tamperer to fraudulently replace the window with another (such as by cutting out the original and attaching another) because it would be very difficult to produce the same registered front-to-back image in a fraudulent replacement window. This is because of the measurable precision of the registration of the front-to-back images and the fact that a suitable inspection of the security document would enable an inspector to verify, from the image in the window, whether or not such registration of the front to back images of an expected "see-through" security feature is present. For exemplary embodiments described herein, this can be done, for example, by illuminating the window from the back of the document which will cause both the front and back images to become visible in the window.

The present invention provides a security feature that is applied to a window of a security document comprising a first image on a first side of the security document in at least an area of the window and a second image on a second side of the security document in at least an area of the window, wherein at least a part of the first image and at least a part of the second image are in front-to-back registration in the areas of the window, the registration of the first and second images being capable of verification by suitable inspection of the window.

A security document (e.g. an identification card, a license and a sheet for a passport) comprising the foregoing security feature is also provided by the invention.

Further, the invention provides a method of securing a window of a security document. A predetermined first image is applied to a first side of the security document in at least an area of the window and a predetermined second image is applied to a second side of the security document in at least an area of the window whereby at least a part of the first image and at least a part of the second image are in front-to-back registration in the areas of the window, the registration of the first and second images being capable of verification by suitable inspection of the window.

The security document may comprise a thermoplastic substrate, and the first and second images may be laser marked on the thermoplastic substrate, with the first image extending from an opacified area of the security document into the area of the window.

Optionally, the first and second images may together have an appearance of a composite image in the window, the first and second images being partial images of the composite image when joined together and the front-to-back registration of the partial images is at the juncture forming the composite image. Another option is for at least a part of the first and second images to provide an appearance in the window of a single image whereby at least a part of the first and second images are identical and the front-to-back registration of the images is at least at those identical parts (e.g. the first and second images comprise different Guilloche patterns). Further, the first and second images comprise micro-text personalized for the holder of the security document and said inspection includes using magnification means.

According to the method, the first and second images may be laser marked onto a targeted location of the substrate relative to the window using a vision input system configured so that only the data captured from the first side of the document is used to mark both the first and second images, and any offset angle captured by the vision input system is ignored.

BRIEF DESCRIPTION OF THE DRAWINGS

The invention is described in detail below with reference to the following drawings drawn to facilitate illustration of features described herein and not to scale.

DETAILED DESCRIPTION

The invention provides a security feature for securing a window of a security document. The security document includes a window in which predetermined images are applied in a front-to-back manner in the area of the window such that at least a part of the image applied to the front of the window and at least a part of the image applied to the back of the window are in front-to-back registration. A suitable inspection of the image appearing in the security document window can verify whether an expected security feature is present (i.e. indicating that the security document is authentic). The term registration used herein is as normally used and understood in the printing industry to refer to precision alignment and placement.

Figure 1:
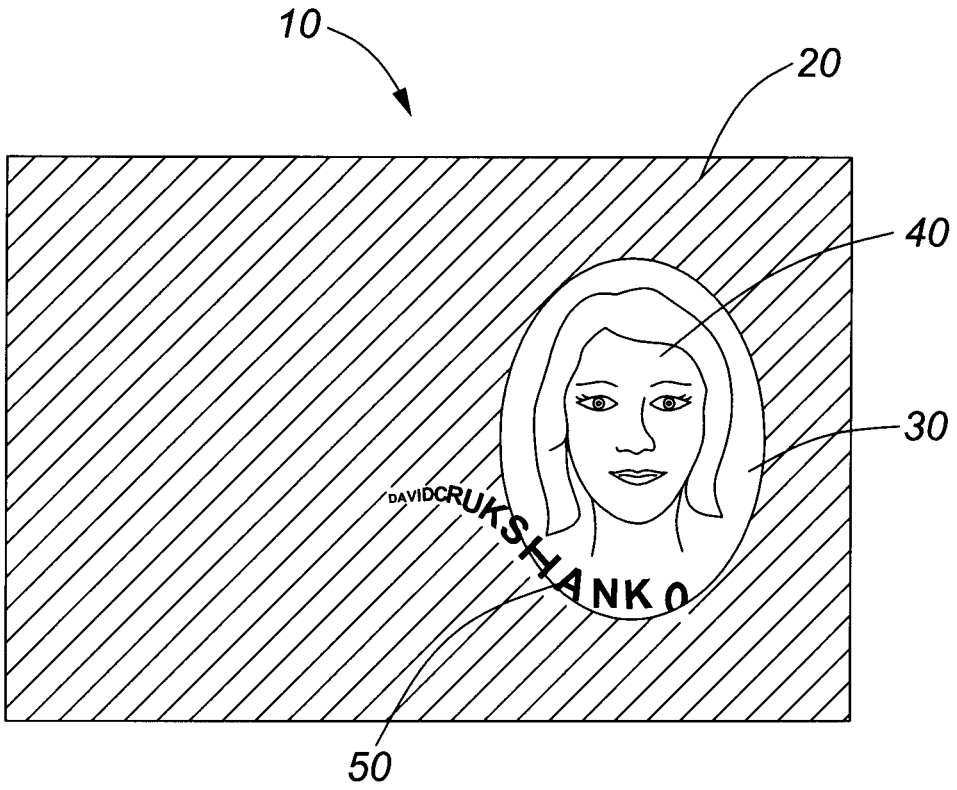
FIG. 1 is front view of an exemplary security document in the form of an identification card having a transparent window in which a personalized image is printed, the identification card including in the area of the window a front-to-back "see-through" security feature, comprising a laser-marked name "David Crukshank", in accordance with the invention.

In an exemplary embodiment of the invention an identification card 10, as illustrated in FIG. 1, is provided. The card 10 comprises a thermoplastic substrate 20 suitable for laser marking, and a laser marked personalization image 40 appears in a window 30 in the card 10. The substrate 20 is opaque (or opacified) outside the area of the window 30 and "see-though" (i.e. transparent) within the area of the window 30. The substrate 20 is comprised of polycarbonate laminate for this embodiment but any suitably markable substrate may be chosen, as appropriate, for another application of the invention. In the area of the window 30 a "see-through" image 50, in the form of a stylized name "DAVID CRUKSHANK" of which the letters "DAVID CRUKSHA" and a first part of the letter "N" are marked on the front of the window and the remainder of the letter "N" and remaining letters of the name (etc.) are marked on the back of the window, in accordance with the invention. The subject matter of the "see-through" image 50 is unlimited and can be chosen as desired for a particular application. For example, it might include personalization information such a name, date or personal number, or a picture, object or symbol.

A Mühlbauer laser engraver, SCP 5600, having a mechanical swivel system to turn the card 10 around with minimal or no X, Y and Phi movement, is used to apply a "see-through" feature, comprising a front-to-back image 50, of the embodiment illustrated in FIG. 1 in accordance with the invention, by marking the front and back surfaces of the card 10 with the front-to-back image 50. The card 10 enters the swivel system to take a first position wherein a front side of the card 10 is laser marked. The card 10 is then rotated to a second position, with minimal X, Y or Phi movement, and the back of the card is laser marked. The rotational movement of the swivel mechanism allows for a perfect front-to-back registration of the laser marking whereby a seamless "see-through" image is visible in the window when viewed.

Figure 2:
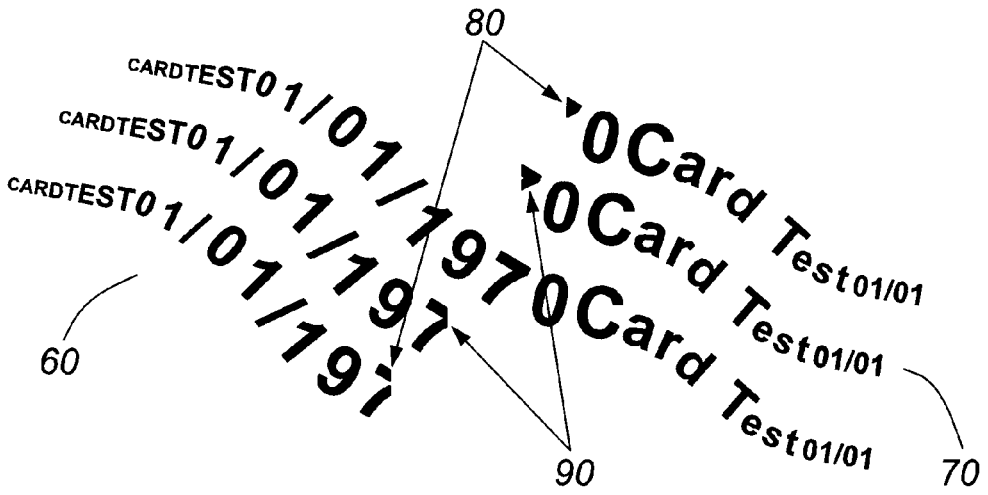
FIG. 2 illustrates exemplary pairs of half images (i.e. the left-most images corresponding to the front image, and the right-most images corresponding to the back image, of a front-to-back image), each half image obtained by cropping an original image, for laser marking on a security document in front-to-back manner in accordance with the invention.

In testing, to investigate the capability of the laser engraver, an original image depicting a stylized "Card Test 01/01/1970 Card Test 01/01/" (shown at the center of FIG. 2 between two sets of half images) was spliced into two left (front) 60 half images and two right (back) 70 half images using a software cropping tool, as illustrated in FIG. 2. As shown, the splice is made through a specific marking i.e. through a preselected line 80, 90 of the letter "7" in this example to avoid cropping at white space and facilitate a determination of the accuracy of the front-to-back registration. The location of the cropping may be user-selected or predetermined. The cropping is achieved by means of a suitable software cropping tool which may be readily configured by a software technician for compatibility with the utilized laser engraver using conventional software techniques and applications as appropriate. The cropping tool vertically crops a user-selectable image at a given distance along an X-axis from a bottom left corner and, preferably, includes an embedded algorithm to adjust the grey value of the last pixel column of the right half image as directed by the user.

Figure 3:
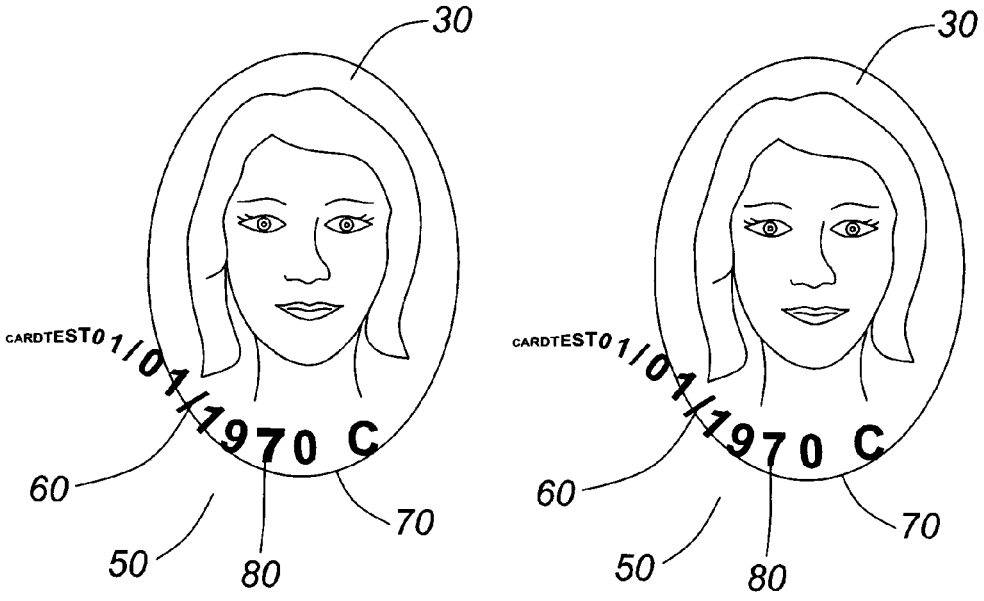
FIG. 3 illustrates two different "see-through" window images in accordance with the invention formed by using different half images of FIG. 2.
Figure 4:
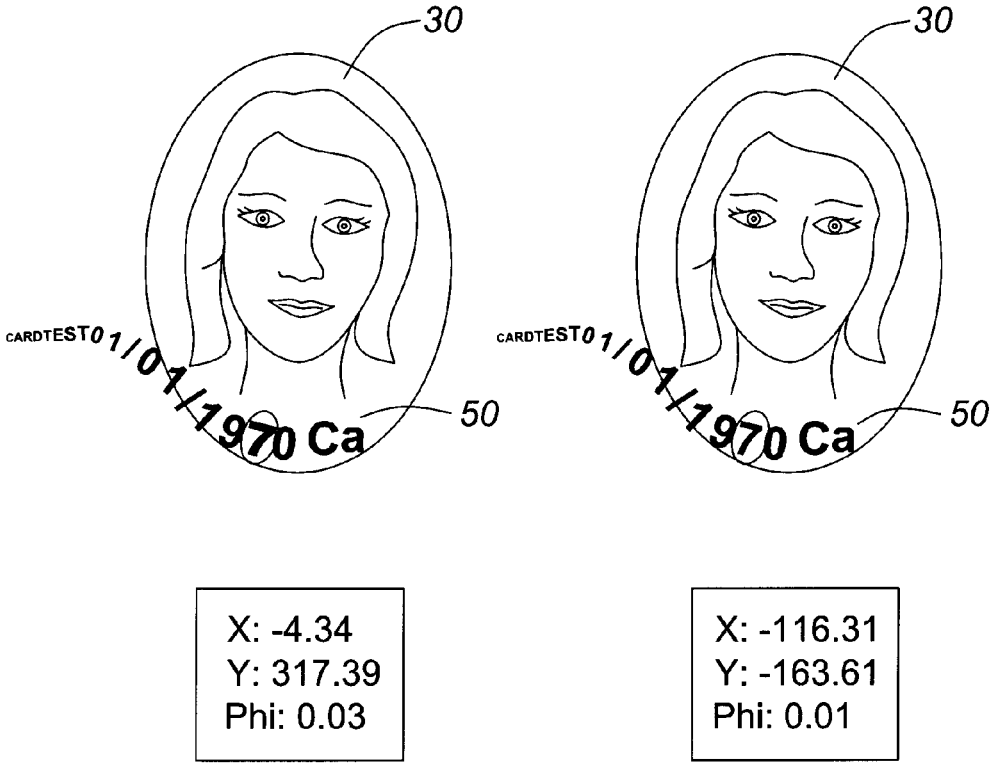
FIG. 4 illustrates the negative effect of applying an offset angle to the marking of the front-to-back images.

Referring to FIG. 3, a left (front) 60 half cropped image was marked on the front side of the card so as to cover an area of the window 30 and the matching right (back) 70 half cropped image was marked on the back side of the card in the window 30 in registration with the front 60 marked half image so that a seamless image, as illustrated, is seen through the window when viewed. It was found that a perfect registered front-to-back image was obtained whether or not a vision input system was used, but a vision input system was found to be important if it is desired to mark the image at a fixed location with respect to the window in order to compensate for variation between cards of the window location. The SCP 5600 has a built-in vision input system that is used for locating any card element such as background print, the window, etc. It uses three variables, namely, X and Y co-ordinates and an angle Phi for rotation, with the X and Y co-ordinates used for the horizontal and vertical distances, respectively.

It was found that the quality of the laser marked image was improved by modifying the cropped half images so as to prevent excessive burning at the juncture where the two images meet due to suboptimal first pulse suppression and/or overlapping. For example, with reference to FIG. 2, the pixels 80 of the first column of the uppermost right (back) 70 half cropped image and the pixels of the last column of its matching lowermost left (front) 60 cropped image are designed to have a "150" grey scale value so that at the juncture 80 (corresponding to the crop line), where they are overlapped front-to-back, the combined value is not too high (a "0" grey scale value corresponding to black and non-image areas having a grey scale value of "255"). Referring to FIG. 3, the "see-through" image 50 shown on the left-hand-side uses cropped half images that have not been so modified so each contributes a "0" grey scale value at the juncture 80 of the two half images (i.e. at the "7") where they are overlapped, causing the appearance at the juncture 80 to show as a darker than that of the adjacent marking. In contrast, the "see-through" image 50 shown on the right-hand-side of FIG. 3 uses cropped half images that have been modified as aforesaid. In this example, the pixels at the columns of the juncture 80 between the front half image 60 and the back half image 70 is modified to have a "155" grey scale value and this lighter shade of grey pixels at the juncture 80 prevents excessive burning where the two half images are overlapped. In the result, the appearance of the letter "N" located at the front-to-back juncture 80 is improved because the overlap is less visible.

The front-to-back registration of the "see-through" image 50 was initially tested without using a vision input system for the laser engraver and registration of the front-to-back images was successfully achieved. However, for purposes of uniformity in card production, when desired for a particular applications, a vision input system may be desired to control the position of the laser marking relative to the window 30 of each card 10. This is because, typically, the exact position of the window 30 will vary from card to card and this will result in variation of the position of the laser marking relative to the window 30. A vision input system, such as that provided by Mühlbauer for use with its laser engraver machine, is designed to enable the user to control the position of the laser marking relative to the window 30.

To align the data to the window 30 of a card 10, the vision input system located on the laser-engraver separately determines an offset of the window 30 for both the front and the back of each card 10. The offset data parameters produced by the vision input system are captured and used by software controlling the vision input system to compensate for the variation in the position of the window.

In a normal situation, a set of data captured on the front side of the card 10 is used to determine the positioning of the laser marking on the front side and a set of data captured on the back side of the card 10 is used for marking the back side. However, for the present application, it was found that using both sets of data resulted in too much overlap between the two (front and back) cropped images, as large as 1 mm, due to variability in the capturing of data and calculations performed by the vision input system. To minimize the overlap, only one offset value (X, Y and Phi) is used for both sides, namely, the data set captured on the front side since it is the first side to be laser marked. In the result, this achieved the desired front-to-back registration for the "see-through" security feature.

It was also found that only the use of X and Y offset values are needed to compensate for the variation in position of the window 30 from card to card. When an angle (Phi) was added to the compensation calculation a slight tilt of the "see-through" image, and excessive (visible) overlapping (namely, darker marking and/or open space at the overlap, depending on the extent of the variation between card window positions) and the character deformation, resulted. To avoid this, the angle offset data collected by the vision input system was ignored in calculating a correction for positioning the "see-through" security feature. Also, only the information collected from the front of the card was used by the vision input system to laser mark both the front and back images of the "see-through" feature.

The "see-through" image of the security feature can be formed from an image that is cropped into two pieces, with each half image marked on either side of the card window in registration at the cropped edge (i.e. the juncture between the two half images) in such a manner that the half images appear to be a continuous image when the window is viewed, as described above and illustrated by FIGS. 1 to 3. Alternatively, rather than establish a continuous image formed from two half images marked front to back in registration, the "see-through" front-to-back security feature may be established by using images which, either in whole or in part, are identical, and marking the images on the front and back of the card window in such a manner that predetermined identical part(s) of the front and back images are in registration, i.e. are perfectly aligned front to back so that the predetermined identical part(s) of the two images appear as a single image when the window is viewed at the angle of alignment. In each case the registration of the front-to-back images would be difficult to counterfeit and, thus, serves to secure the window to the rest of the card.

FIGS. 5 through 8 illustrate a number of different examples of "see-through" security features in accordance with the invention which can be utilized to secure a window of a security document.

Figure 5:
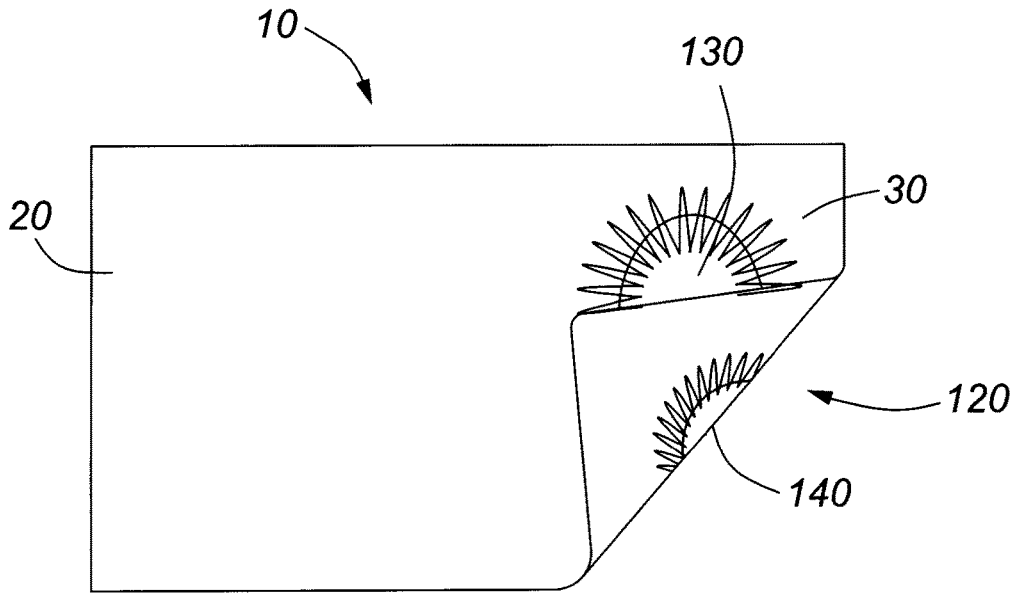
FIGS. 5 to 8 illustrate a number of different examples of "see-through" security features in accordance with the invention, for securing a window of a security document.
Figure 6:
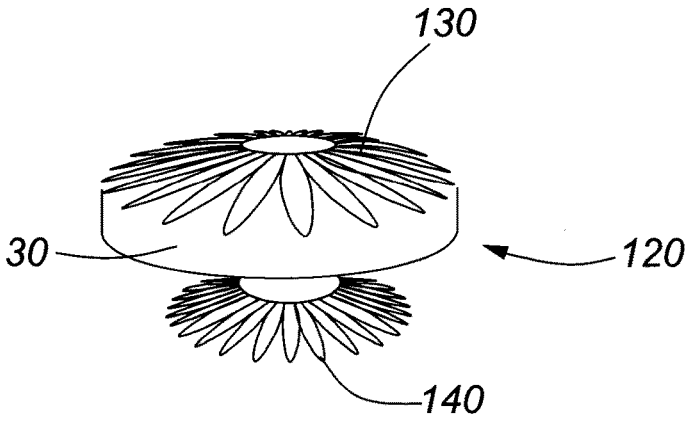
Figure 7:
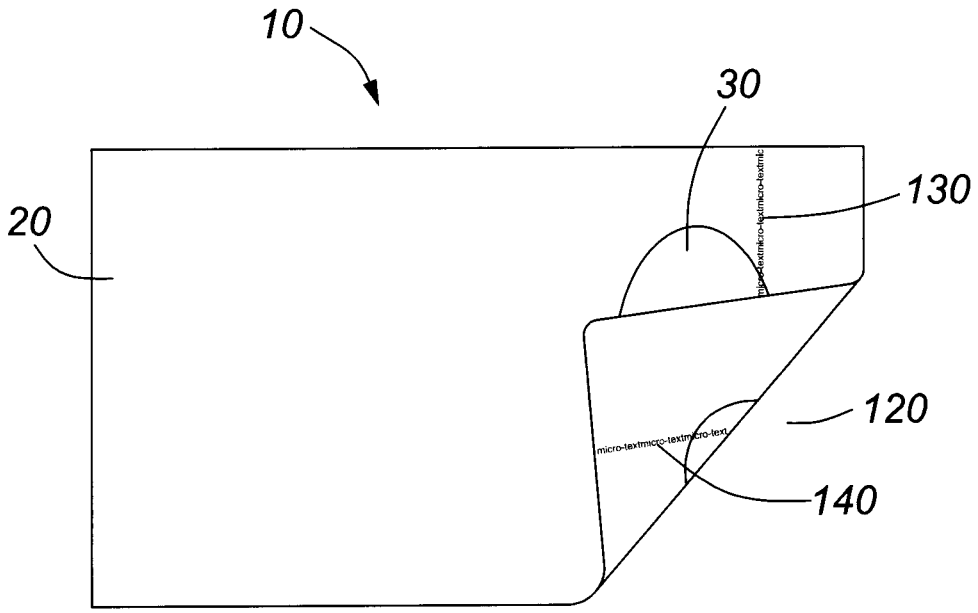
Figure 8:
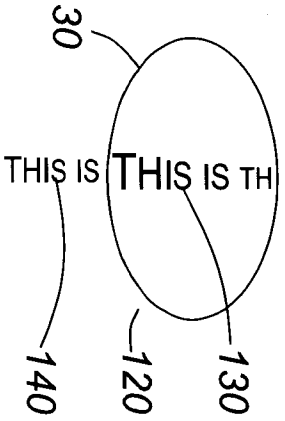

FIGS. 5 and 6 illustrate a "see-through" security feature 120 comprising two different Guilloche patterns 130, 140, one marked on the front of the card window 30 and the other marked on the back of the card window 30. Both patterns 130, 140 have at least one similar line arrangement which overlaps perfectly with each other in the transparent window 30 and this registration of those parts of the front and back images establishes a "see-through" security feature 120 that would be difficult to counterfeit. FIGS. 7 and 8 illustrate a "see-through" security feature 120 of which the front and back images comprise micro-text marked in front to back registration. The micro-text is of too small a size to be read without the use of magnification means but when using magnification means to view the micro-text images in alignment in the window 30 they appear as a single image. Advantageously, the micro-text can be personalized to further secure the card window and data of the card holder.

What is claimed is:

1. A security feature applied to a window of a security document by a laser engraver, comprising:

(a) a first image on a first side of the security document in at least an area of the window; and, (b) a second image on a second side of the security document opposite said first side in at least an area of the window;

wherein the security document comprises a thermoplastic substrate, the first image is laser marked on said first side of the thermoplastic substrate by the laser engraver and then the second image is laser marked on said second side of the thermoplastic substrate by said laser engraver, at least a part of the first image and at least a part of the second image are in front-to-back registration in the areas of the window at at least one juncture, wherein the security feature is a composite image that extends from the front to the back of the document in the area of the transparent window and is defined by discoloration within the thermoplastic substrate, said registration of the first and second images being capable of verification by suitable inspection of the window.

2. A security feature according to claim 1 wherein the first and second images are partial images of the composite image when joined together at the at least one juncture, and the first and second images have reduced darkness at the juncture thereof to prevent excessive burning and the first and second images together have an appearance of the composite image in the window.

3. A security feature according to claim 2 wherein the first image extends from an opacified area of the security document into the area of the window.

4. A security feature according to claim 1 wherein at least a part of the first and second images are identical and the at least one juncture occurs at at least one of the identical parts, the first and second images having an appearance in the window of a single image at the identical parts.

5. A security feature according to claim 1 wherein said first and second images further comprise different Guilloche patterns.

6. A security feature according to claim 1 wherein the first and second images comprise micro-text personalized for the holder of the security document and said inspection includes using magnification means.

7. A security feature according to claim 1 wherein a mechanical swivel mechanism moves the security document from a first position to a second position.

8. A security document comprising the security feature of claim 1.

9. A security document according to claim 8 selected from a group comprising an identification card, a license and a sheet for a passport.

10. A method of securing a window of a security document with a laser engraver, comprising:

(a) applying a predetermined first image to a first side of the security document in at least an area of the window; and, (b) applying a predetermined second image to a second side of the security document opposite said first side in at least an area of the window;

wherein the security document comprises a thermoplastic substrate, the first image is laser marked on said first side of the thermoplastic substrate by the laser engraver and then the second image is laser marked on said second side of the thermoplastic substrate by said laser engraver, whereby at least a part of the first image and at least a part of the second image are in front-to-back registration in the window at at least one juncture between the first and second images, whereby said registration of the first and second images forms a composite image that extends from the front to the back of the document in the area of the transparent window and is defined by discoloration within the thermoplastic substrate, said registration of the first and second images being capable of verification by suitable inspection of the window.

11. A method according to claim 10 whereby the first and second images are partial images of the composite image when joined together at the at least one juncture, and the first and second images are modified to reduce the darkness of the first and second images at the juncture, the first and second images together having an appearance of the composite image in the window.

12. A method according to claim 11 whereby at least a part of the first and second images are identical and the at least one juncture is at at least one of the identical parts, the first and second images having an appearance in the window of a single image at the identical parts.

13. A method according to claim 10 whereby the first and second images are laser marked onto a targeted location of the substrate relative to the window using a vision input system which only uses X and Y co-ordinate offset data parameters captured from the first side of the document to mark both the first and second images.

14. A method according to claim 10 wherein the security document is moved from a first position to a second position by a mechanical swivel mechanism.

15. A security document comprising the security feature of claim 2.

16. A security document comprising the security feature of claim 3.

17. A security document comprising the security feature of claim 4.

* * * * *